US008016017B2

(12) United States Patent
Cloninger et al.

(10) Patent No.: US 8,016,017 B2
(45) Date of Patent: Sep. 13, 2011

(54) BARRIER SYSTEMS AND ASSOCIATED METHODS, INCLUDING VAPOR AND/OR FIRE BARRIER SYSTEMS

(75) Inventors: James N. Cloninger, Boise, ID (US); Kelsey S. Aldrich, Boise, ID (US)

(73) Assignee: Smoke Guard, Inc., Boise, ID (US)

( * ) Notice: Subject to any disclaimer, the term of this patent is extended or adjusted under 35 U.S.C. 154(b) by 979 days.

(21) Appl. No.: 11/828,974

(22) Filed: Jul. 26, 2007

(65) Prior Publication Data

US 2010/0024992 A1 Feb. 4, 2010

(51) Int. Cl.
*E06B 9/70* (2006.01)

(52) U.S. Cl. ..... 160/310; 160/7

(58) Field of Classification Search ..... 160/310, 160/265, 7, 1, 188, 189, 273.1, 120, 84.02; 49/26, 27, 28; 318/265, 266, 267, 282, 286
See application file for complete search history.

(56) References Cited

U.S. PATENT DOCUMENTS

| | | | | |
|---|---|---|---|---|
| 842,968 | A | 2/1907 | McCloud | |
| 862,644 | A | 8/1907 | Kepler | |
| 1,471,572 | A | 10/1923 | Rydberg | |
| 2,247,306 | A | 6/1941 | Partridge | |
| 2,280,135 | A | 4/1942 | Ward | |
| 2,354,832 | A | 8/1944 | Ristine | |
| 2,383,015 | A | 8/1945 | Pratt | |
| 2,564,208 | A | 8/1951 | Michelman | |
| 2,582,276 | A | 1/1952 | Powers | |
| 2,871,933 | A | 2/1959 | Kroger | |
| 3,006,352 | A | 10/1961 | Hozak | |
| 3,016,952 | A | 1/1962 | Shero | |
| 3,053,676 | A | 9/1962 | Higbee | |
| 3,240,484 | A * | 3/1966 | Klamp | 160/189 |
| 3,306,345 | A | 2/1967 | Youngs | |
| 3,398,779 | A | 8/1968 | Kuss | |
| 3,687,185 | A | 8/1972 | Singer | |
| 3,766,958 | A | 10/1973 | Mitchell | |
| 3,807,480 | A | 4/1974 | Smart | |
| 3,877,525 | A | 4/1975 | Husson et al. | |
| 3,913,309 | A | 10/1975 | Chiarotto | |

(Continued)

FOREIGN PATENT DOCUMENTS

| | | |
|---|---|---|
| CH | 560833 | 4/1975 |

(Continued)

OTHER PUBLICATIONS

International Search Report for Application No. PCT/US07/74626; Applicant: SmokeGuard, Inc.; Date of Mailing: Jul. 26, 2007 (2 pages).
International Search Report for PCT/US07/74626; Smoke Guard, Inc.; Julu 21, 2008; pp. 1-8.
U.S. Appl. No. 60/315,303, Sears et al.
U.S. Appl. No. 11/105,132, Cloninger et al.
Coopers Fire & Smoke Engineering, "FireMasterPlus the 4hr F R Fire Curtain with 1+ hr Insulation," Product Data Sheet, Undated, 1 page.
Japan Testing Center for Construction Materials, "Quality performance test report: Smoke Guard Type 1, fire preventative type," May 11, 2006, 5 pages.
Non-Final Office Action for U.S. Appl. No. 12/353,747, Mail Date May 9, 2011, 22 pages.

*Primary Examiner* — David Purol
(74) *Attorney, Agent, or Firm* — Perkins Coie LLP

(57) ABSTRACT

Barrier systems and associated methods, including vapor and/or fire barrier systems, are disclosed herein. One aspect of the invention is directed toward a barrier system that includes a barrier coupled to a spool. The barrier is positioned to be wound onto and off of the spool as the barrier moves between a deployed position and a retracted position by a drive assembly. The system further includes a control system coupled to the drive assembly and configured to command operation of the drive assembly. The system still further includes a sensor operably coupled to the control system and positioned to sense barrier position as the barrier moves between the deployed and the retracted positions.

34 Claims, 8 Drawing Sheets

U.S. PATENT DOCUMENTS 3,916,057 A 10/1975 Hatch et al.
3,934,066 A 1/1976 Murch
3,934,285 A 1/1976 May
3,955,330 A 5/1976 Wendt
3,960,216 A 6/1976 Isobe et al.
3,964,214 A 6/1976 Wendt
3,990,635 A 11/1976 Restle et al.
4,077,474 A 3/1978 Hattori et al.
4,079,772 A 3/1978 Klaenhammer et al.
4,216,261 A 8/1980 Dias
4,226,907 A 10/1980 Sienkowski et al.
4,282,276 A 8/1981 Smith
4,282,284 A 8/1981 George
4,357,978 A 11/1982 Keller et al.
4,398,371 A 8/1983 Jenkins
4,398,585 A 8/1983 Marlow
4,444,825 A 4/1984 Vanderstukken et al.
4,458,739 A 7/1984 Murray et al.
4,463,465 A 8/1984 Parker et al.
4,500,593 A 2/1985 Weber
4,509,559 A 4/1985 Cheetham et al.
4,569,878 A 2/1986 Barrall et al.
4,572,862 A 2/1986 Ellis
4,597,430 A 7/1986 Marquez
4,623,583 A 11/1986 Mischutin
4,663,204 A 5/1987 Langham
4,670,327 A 6/1987 Weber
4,718,471 A * 1/1988 Kraeutler ..... 160/84.02
4,755,407 A 7/1988 Mortensen et al.
4,756,945 A 7/1988 Gibb
4,778,544 A 10/1988 Jones et al.
4,802,523 A 2/1989 Scholten et al.
5,048,588 A * 9/1991 Weishar et al. ..... 160/265
5,056,839 A 10/1991 Yoon et al.
5,088,543 A 2/1992 Bilbrey
5,091,243 A 2/1992 Tolbert et al.
5,195,594 A 3/1993 Allen
5,199,478 A 4/1993 Kubota et al.
5,233,821 A 8/1993 Weber, Jr. et al.
5,237,776 A 8/1993 Kubota et al.
5,353,859 A * 10/1994 Oltahfer et al. ..... 160/310
5,373,932 A 12/1994 Stobich et al.
5,383,510 A 1/1995 Allen
5,389,309 A 2/1995 Lopez
5,482,103 A 1/1996 Burgess et al.
5,509,983 A 4/1996 Yu
5,540,269 A 7/1996 Plumer et al.
5,544,690 A 8/1996 Magro et al.
5,578,387 A 11/1996 Kai et al.
5,607,758 A 3/1997 Schwartz
5,614,256 A 3/1997 Wierer et al.
5,618,595 A 4/1997 Matsushima et al.
5,679,277 A 10/1997 Niibe et al.
5,747,392 A 5/1998 Xiao et al.
5,758,705 A 6/1998 Wagner et al.
5,794,678 A 8/1998 Beringer et al.
5,836,424 A 11/1998 Allen
5,862,851 A 1/1999 Stoebich
5,879,767 A 3/1999 Matsushima et al.
5,896,907 A 4/1999 Dever et al.
5,921,420 A 7/1999 Gordon et al.
5,924,589 A 7/1999 Gordon
5,984,126 A 11/1999 Gordon
6,019,156 A 2/2000 Wagner et al.
6,070,640 A 6/2000 Miyagawa et al.
6,082,432 A 7/2000 Kissinger
6,138,739 A 10/2000 Crider et al.
6,201,364 B1 3/2001 Will et al.
6,207,250 B1 3/2001 Bullock et al.
6,251,210 B1 6/2001 Bullock et al.
6,265,082 B1 7/2001 Dunham et al.
6,357,507 B1 3/2002 Stoebich et al.
6,492,001 B1 12/2002 Rubin et al.
6,541,138 B2 4/2003 Bullock et al.
6,574,930 B2 6/2003 Kiser
6,708,456 B2 3/2004 Kiik et al.
6,715,183 B1 4/2004 Lautenschlager et al.
6,858,550 B2 2/2005 Ahluwalia
6,884,491 B2 4/2005 Rubin et al.
6,990,779 B2 1/2006 Kiik et al.
7,000,668 B2 2/2006 Sears et al.
7,028,742 B2 4/2006 Sears et al.
7,034,682 B2 4/2006 Beggs et al.
7,150,059 B2 12/2006 Small, Jr. et al.
7,168,231 B1 1/2007 Chou et al.
7,225,487 B2 6/2007 Small, Jr. et al.
7,361,617 B2 4/2008 Ahluwalia
7,735,539 B2 6/2010 Nakamura et al.
2002/0059985 A1 5/2002 Stoebich et al.
2003/0051829 A1 3/2003 Sears et al.
2005/0061452 A1* 3/2005 Sears et al. ..... 160/7
2006/0226103 A1 10/2006 Streib
2009/0250174 A1 10/2009 Cloninger et al.
2010/0243175 A1 9/2010 Gonzales et al.

FOREIGN PATENT DOCUMENTS

DE 2848069 5/1980
DE 3044876 12/1981
DE 3044877 12/1981
DE 8221858 U 11/1982
DE 8031741 U 12/1982
DE 3151506 7/1983
DE 8313824 U 11/1983
DE 3417761 11/1985
DE 4102330 8/1992
DE 59100210D 9/1993
DE 19611515 10/1996
DE 19610532 11/1996
DE 19718238 A1 11/1998
DE 19836008 2/2000
DE 29922593 4/2000
DE 19925722 12/2000
DE 19655126 5/2001
DE 20218709 U 2/2003
DE 20303183 U 5/2003
DE 10213811 10/2003
DE 10225251 12/2003
DE 10234802 2/2004
DE 10325237 12/2004
DE 102004019262 12/2004
DE 202004018977 2/2005
DE 202006003388 U 6/2006
DE 202006009416 U 8/2006
DE 202006009851 U 9/2006
EP 124910 11/1984
EP 163987 12/1985
EP 0440094 8/1991
EP 440094 8/1991
EP 1215362 6/2002
EP 1249255 10/2002
EP 1669110 6/2006
FR 2617230 12/1988
GB 2060744 5/1981
GB 2108839 5/1983
GB 2202890 10/1988
GB 2332860 7/1999
JP 52101232 8/1977
JP 60040455 3/1985
JP 9013533 1/1997
JP 9078726 3/1997
JP 9203281 8/1997
JP 9217256 8/1997
JP 9263463 10/1997
JP 9263464 10/1997
JP 9263465 10/1997
JP 10102628 4/1998
JP 10152913 6/1998
JP 10152914 6/1998
JP 10324542 12/1998
JP 2000017977 1/2000
JP 2000246821 9/2000
JP 2001107660 4/2001
WO WO-97/43011 11/1997
WO WO-03080188 10/2003

* cited by examiner

BARRIER SYSTEMS AND ASSOCIATED METHODS, INCLUDING VAPOR AND/OR FIRE BARRIER SYSTEMS

TECHNICAL FIELD

Embodiments of the present invention relate to barrier systems and associated methods, including vapor and/or fire barrier systems.

BACKGROUND

Smoke, fumes, and noxious gasses can be very dangerous to occupants during a building fire. It is well known that many fire-related deaths are the result of smoke inhalation. During a fire, or an event where dangerous gases may be present, fumes are likely to travel very quickly through paths that offer little resistance. Paths such as elevator shafts are often well drafted and provide an excellent avenue by which smoke and other dangerous gases can rapidly travel to otherwise unaffected areas of a building. To prevent such a migration of dangerous gases, many devices and assemblies have been designed to limit the dispersal of such fumes by cutting off possible paths or openings. Examples of such devices are smoke screen assemblies disclosed in U.S. Pat. No. 5,383,510, entitled APPARATUS AND METHOD FOR RAPIDLY AND RELIABLY SEALING OFF CERTAIN OPENINGS IN RESPONSE TO SMOKE, NOXIOUS FUMES OR CONTAMINATED AIR, issued Jan. 24, 1995; U.S. Pat. No. 5,195,594, entitled APPARATUS AND METHOD FOR RAPIDLY AND RELIABLY SEALING OFF CERTAIN EXIT AND ENTRANCE WAYS IN RESPONSE TO SMOKE OR FIRE, issued Mar. 23, 1993; U.S. Pat. No. 7,000,668, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Feb. 21, 2006; U.S. Pat. No. 7,028,742, entitled SYSTEM AND METHOD FOR SEALING OPENINGS IN RESPONSE TO SMOKE, NOXIOUS FUMES, OR CONTAMINATED AIR USING A ROLL-DOWN BARRIER, issued Apr. 18, 2006; and U.S. Patent Application No. 2006/0226103, entitled CLOSING MEMBER CONTROL SYSTEMS, INCLUDING DOOR CONTROL SYSTEMS FOR BARRIER HOUSINGS, AND ASSOCIATED METHODS, filed Oct. 12, 2006; each of which is incorporated herein by reference in its entirety.

DETAILED DESCRIPTION

Figure 1:
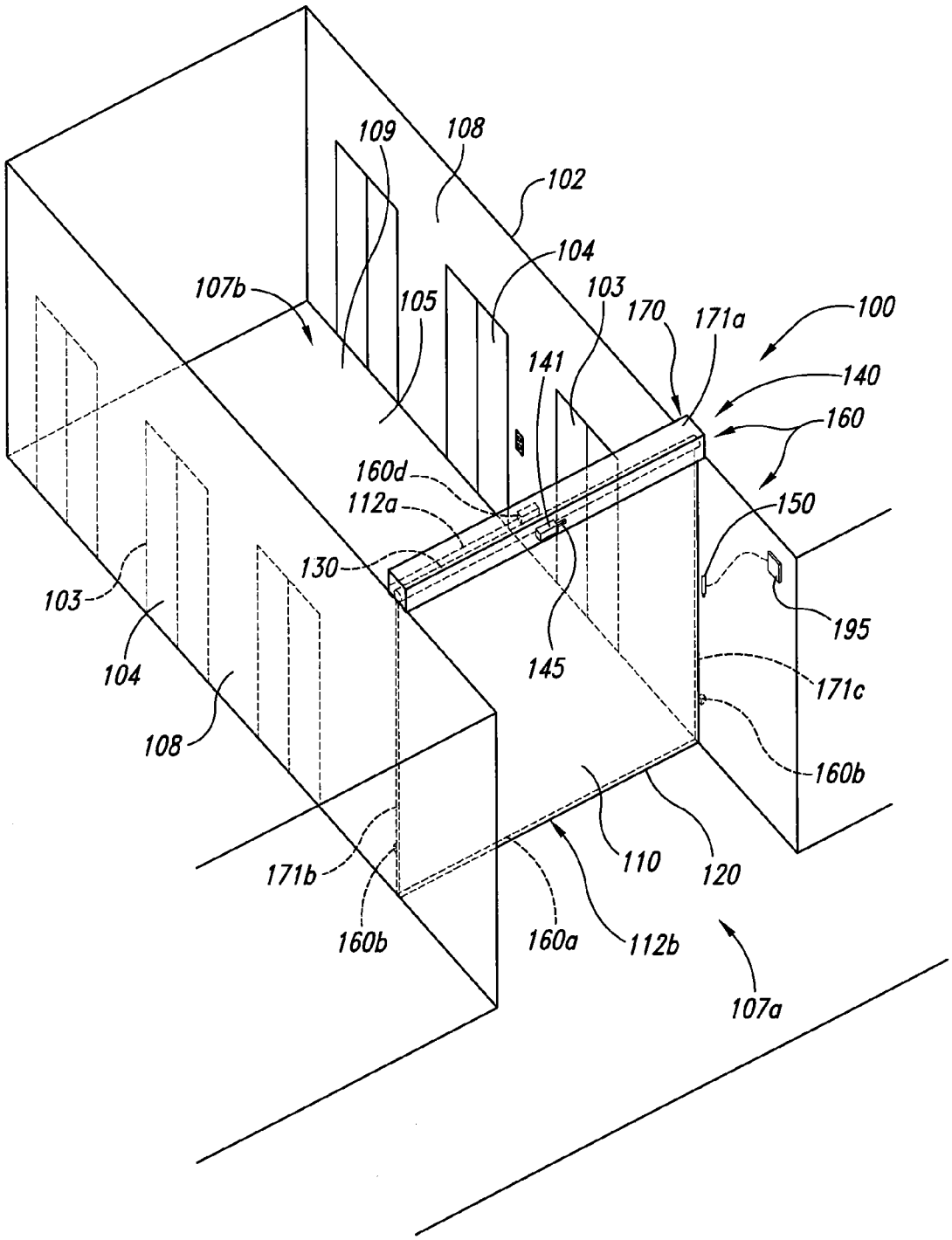
FIG. 1 is an isometric illustration of a barrier system in accordance with embodiments of the invention.

Aspects of the present invention are directed generally toward barrier systems and associated methods, including vapor and/or fire barrier systems. One aspect of the invention is directed toward a barrier system that includes a flexible barrier having a first end and a second end. The barrier is movable between a deployed position and a retracted position. The system further includes a spool coupled to the first end of the flexible barrier. The barrier is positioned to be wound onto and off of the spool as the barrier moves between the deployed and the retracted positions. The system still further includes a drive assembly coupled to the second end of the barrier and configured to enable movement of the second end of the barrier toward the spool as the barrier moves toward the retracted position and away from the spool as the barrier moves toward the deployed position. The system yet further includes a control system coupled to the drive assembly and configured to command operation of the drive assembly. The system still further includes a sensor operably coupled to the control system and positioned to sense barrier position as the barrier moves between the deployed and the retracted positions.

Other aspects of the invention are directed toward a barrier system that includes a flexible barrier having a first end and a second end. The system further includes a spool coupled to the first end of the flexible barrier. The barrier is positioned to be wound onto and off of the spool. The system still further includes a drive assembly coupled to the second end of the flexible barrier and configured to enable movement of the second end of the flexible barrier toward and away from the spool as the barrier is wound onto and off of the spool.

Still other aspects of the invention are directed toward a barrier system that includes a flexible barrier movable between a deployed position and a retracted position. The system further includes a drive assembly coupled to the barrier to enable movement of the barrier between the deployed and retracted positions. The system still further includes a control system coupled to the drive assembly and configured to command operation of the drive assembly. The system yet further includes a sensor operably coupled to the control system and positioned to sense barrier position as the flexible barrier moves between the deployed and the retracted positions.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section. As used herein vapor includes gases or gases carrying particulates (e.g., solid and/or liquid particulates), such as smoke, fumes, smoke with soot particles, contaminated air, noxious fumes, and/or the like.

References throughout the specification to "one embodiment" or "an embodiment" means that a particular feature, structure, or characteristic described in connection with the embodiment and included in at least one embodiment of the present invention. Thus, the appearances of the phrase "in one embodiment" or "in an embodiment" in various places throughout the specification are not necessarily all referring to the same embodiment. Furthermore, the particular features, structures, or characteristics may be combined in any suitable manner in one or more embodiments.

FIGS. 1-9 illustrate various features of a barrier system 100 in accordance with various embodiments of the invention. FIG. 1 is an isometric illustration of the barrier system 100 that is located generally proximate to at least one passageway or opening 103 in a structure 102. In the illustrated embodiment, a plurality of openings 103 in the structure 102 are a hoistway openings between elevator shafts and a hallway, such as an elevator lobby 105 on a floor 107 of a building. In FIG. 1, movable elevator doors 104 can prevent access to the shaft when an elevator car is not present. However, as mentioned above, in the event of a fire these elevator doors may not sufficiently prevent vapors and/or fire from migrating through the opening 103. Accordingly, in the illustrated embodiment the barrier system 100 is positioned to sealably extend across the elevator lobby between two opposing walls 108, when the barrier system 100 is in a deployed position (shown in FIG. 1), thereby substantially sealing off the elevator lobby 105 and the elevator shafts from the rest of the floor. For example, the barrier system 100 can be positioned to at least approximately seal a passageway or opening in the building structure between the elevator lobby and the rest of the floor. In other embodiments, the barrier system can be positioned proximate to one or more of the opening(s) 103 so that in the deployed position the barrier system 100 at least approximately seals the associated elevator shaft(s) and the lobby 105 from one another.

In selected embodiments, the barrier system 100 includes a flexible barrier 110 that can include a fabric smoke barrier or curtain and/or a fire barrier or curtain and in the deployed position can resist the movement or migration of vapors and/or fire (e.g., flames, burning materials, high temperature gases, and/or the like) between the elevator lobby and the rest of the floor. When the barrier 110 is in a retracted position (shown in FIG. 2), the portion of the elevator lobby is unblocked allowing an individual to pass to and from the elevators.

In FIG. 1, the barrier system 100 includes a drive assembly 140 coupled to the flexible barrier 110 to enable movement of the barrier between the retracted and deployed position. For example, in selected embodiments the drive assembly 140 can apply a force to move the barrier 110 between the retracted and deployed position. In other embodiments, the drive assembly 140 can allow other forces to move the barrier 110 between the deployed and retracted position, for example, by at least partially releasing a force resisting the movement of the barrier 110.

The barrier system 100 includes a control system 150 coupled to the drive assembly 140 and configured to command movement or operation of the drive assembly 140, which in turn can control movement of the barrier 110. In FIG. 1, the barrier system 100 also includes one or more sensors 160 operably coupled to the control system 150. For example, the sensor(s) 160 can be positioned to sense the barrier's position as the barrier 110 moves between the deployed and retracted positions, to sense when the barrier is in the retracted and/or the deployed positions, and/or to sense when a portion of the barrier contacts a surface. The sensor 160 can include various types of sensors including proximity sensors, electromagnetic sensor, electro-mechanical sensors, mechanical sensors, optical sensors, and/or the like. In the illustrated embodiment, the barrier system 100 includes a first sensor 160*a*, a second sensor 160*b*, a third sensor 160*c*, and a forth sensor 160*d*, which are discussed in further detail below. In FIG. 1, the control system 150 is also operably coupled to at least one external device 195 associated with the barrier system 100, such as a fire alarm/detector, a smoke alarm/detector, an external monitoring system that monitors and displays the status of the barrier system 100 (or provides remote control of the system), and/or the like.

In selected embodiments, the control system 150 can include a computing system or computer and can be configured with instructions to control the movement of the drive assembly, to control the movement of the barrier, to communicate with external devices 195, to perform various monitoring tasks, to perform various calibration tasks, to provide or display the status of at least a portion of the barrier system 100, and/or the like. In certain embodiments, the control system 150 can include a display for displaying associated information and/or a control panel or key pad that allows a user to provide inputs to the control system 150 (e.g., to control the barrier system 100). The barrier system 100 can also include various pathways 166 for communicating information between components, transferring power (e.g., electrical power), and/or the like. In selected embodiments, these pathways can include wires, connectors, fiber optic cables/devices, wireless communication devices, and/or the like.

For example, in one embodiment the external device 195 can include a detector for detecting fire or selected vapor(s) (e.g., smoke). The detector can have at least two states including a first state where the detector does not sense the selected vapor(s) or fire (or where the detector senses the absence of the selected vapor(s) or fire) and a second state where the detector senses at least one of the selected vapor(s) and fire. The control system 150 can be configured to command the drive assembly 140 to enable movement of the barrier 110 toward the deployed position when the detector is in the second state. In certain embodiments, the control system 150 can be configured to command the drive assembly 140 to enable movement of the barrier 110 toward the retracted position when the detector is in the first state and the barrier 110 is not in the retracted position, for example, after the barrier 110 has been deployed in response to the detector sensing the selected vapor(s) and the selected vapor(s) have cleared.

In FIG. 1, the housing assembly 170 includes an upper portion 171*a* disposed in a ceiling structure, such as above an entry portion of the elevator lobby, and spanning between the opposing sidewalls of the elevator lobby. The housing assembly can include first and second side portions 171*b* and 171*c* disposed in or on the opposing sidewalls of the elevator lobby and below the ends of the upper portion 171*a*. As discussed in further detail below, in selected embodiments when the barrier 110 is in the deployed position the housing assembly 170 and barrier 110 can form a tortuous path that resists the movement of vapor(s) and/or fire (e.g., flames, high temperatures, etc.) between the elevator lobby 105 and the rest of the floor.

Figure 2:
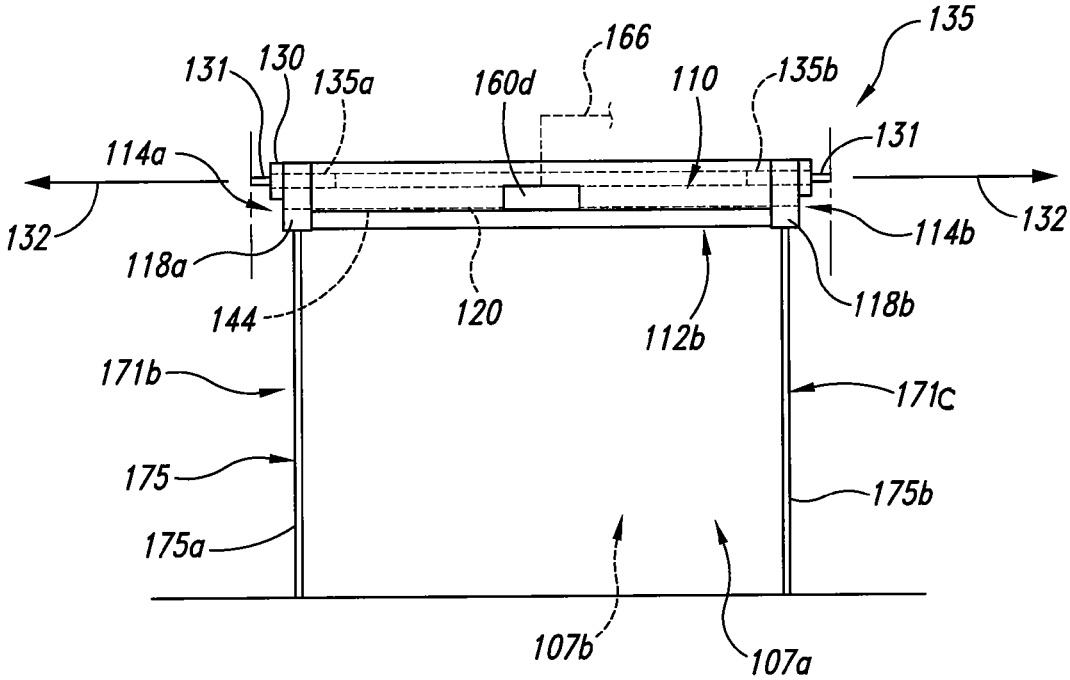
FIG. 2 is a partially schematic cross-sectional front elevation view of a portion of the barrier system shown in FIG. 1.
Figure 3:
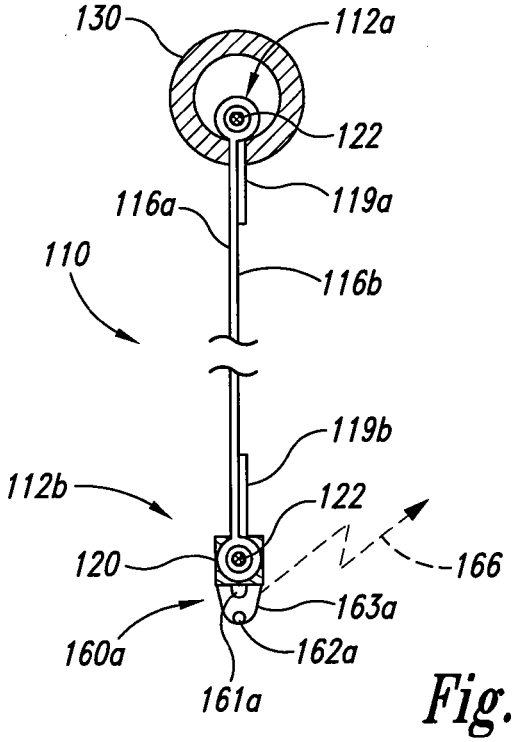
FIG. 3 is a partially schematic cross-sectional enlarged side elevation view of a barrier of the barrier system shown in FIG. 1.

FIG. 2 is a partially schematic, cross-sectional front elevation view of a portion of the barrier system shown in FIG. 1. In FIG. 2, a spool 130 is positioned at least partially within the upper portion 171*a*. In the illustrated embodiment the spool 130 is carried by the housing assembly 170 via one or more axles 131. As shown in FIG. 3, the spool 130 is coupled to a first end 112*a* of the barrier 110. Accordingly, barrier 110 is positioned to be wound onto the spool 130 as the barrier 110 moves toward the retracted position and off of the spool 130 as the barrier 110 move towards the deployed position.

For example, as shown in FIG. 2, the spool 130 can be carried by the housing assembly 170 so that the spool's axis of rotation 132 is fixed relative to the housing assembly 170 (e.g., the axles 131 are coupled to the housing 170 to rotate about a fixed position relative to the housing assembly 170) and/or fixed in space. In selected embodiments, the drive assembly 140 can be coupled to a second end 112*b* of the barrier 110 and configured to move or enable movement of the second end 112*b* of the barrier 110 away from the spool 130 toward the deployed position. As the second end 112*b* of the barrier moves away from the spool 130, the spool rotates and the barrier 110 is wound off of the spool 130. In selected embodiments, the barrier system 110 can include one or more urging or resilient elements 135 (e.g., spring devices) coupled to the spool 130. In the illustrated embodiment, the barrier system 110 includes two resilient elements shown as a first resilient element 135*a* and a second resilient element 135*b*. The resilient elements 135 can have a rest position and can be configured so that when the resilient elements are displaced away from the rest position the resilient elements have a tendency to return to the rest position.

The spool can be coupled to the resilient elements 135 so that when the barrier 110 is wound off of the spool 130, the resilient elements 135 are displaced away from the rest position. Accordingly, as the barrier 110 is wound off of the spool 130, the resilient elements 135 can supply an urging force or can urge the spool to rotate in a manner that will wind the barrier 110 onto the spool 130. Therefore, in certain embodiments when the barrier 110 is not in the retracted position, the drive assembly 140 can move the second end 112*b* of the barrier 110 toward the spool (e.g., moving the barrier toward the retracted position) and the resilient elements 135 can apply an urging force to the spool 130 to aid in winding the barrier onto the spool 130. In other embodiments, the drive assembly 140 can enable movement of the barrier 110 toward the retracted position by releasing at least a portion of a force resisting the movement of the barrier toward the retracted position, thereby allowing the resilient elements 135 to wind the barrier 110 onto the spool 130. In other embodiments the drive assembly, barrier, and resilient elements can have other arrangements. For example, in selected embodiments the barrier system can include more or fewer resilient elements including no resilient elements. In other embodiments, the rest position of the resilient element(s) can be positioned so that the resilient element(s) are displaced away from the rest position when the barrier is moved toward the retracted position.

FIG. 3 is a partially schematic cross-sectional side elevation view of the flexible barrier 110. The barrier 110 (along with other portions of the barrier system 100) can be made from various materials. For example, in selected embodiments the barrier 110 and barrier system 100 can be configured so that the barrier system 100 can meet various industry standards to qualify as a smoke partition, a fire partition, a fire barrier, a smoke barrier, and/or a fire wall (e.g., in accordance with standards associated with the International Building Code, International Code Congress, NPFA Life Safety Code, etc.). For instance, in one embodiment the barrier can include a flexible and foldable material that includes fiberglass that has been impregnated and/or coated with a flouropolymer such as a polytetraflouroethylene (PTFE) (e.g., such as Teflon®). In selected embodiments, a PTFE-coated material suitable for use as a smoke barrier can include CHEMFAB® (e.g., with a thickness of 0.003-0.004 inches), available from Saint-Gobain Performance Plastics Corporation of Elk Grove Village, Ill. In other embodiments, the barrier 110 can have other configurations, including being made from other materials and/or having other thicknesses.

Figure 5:
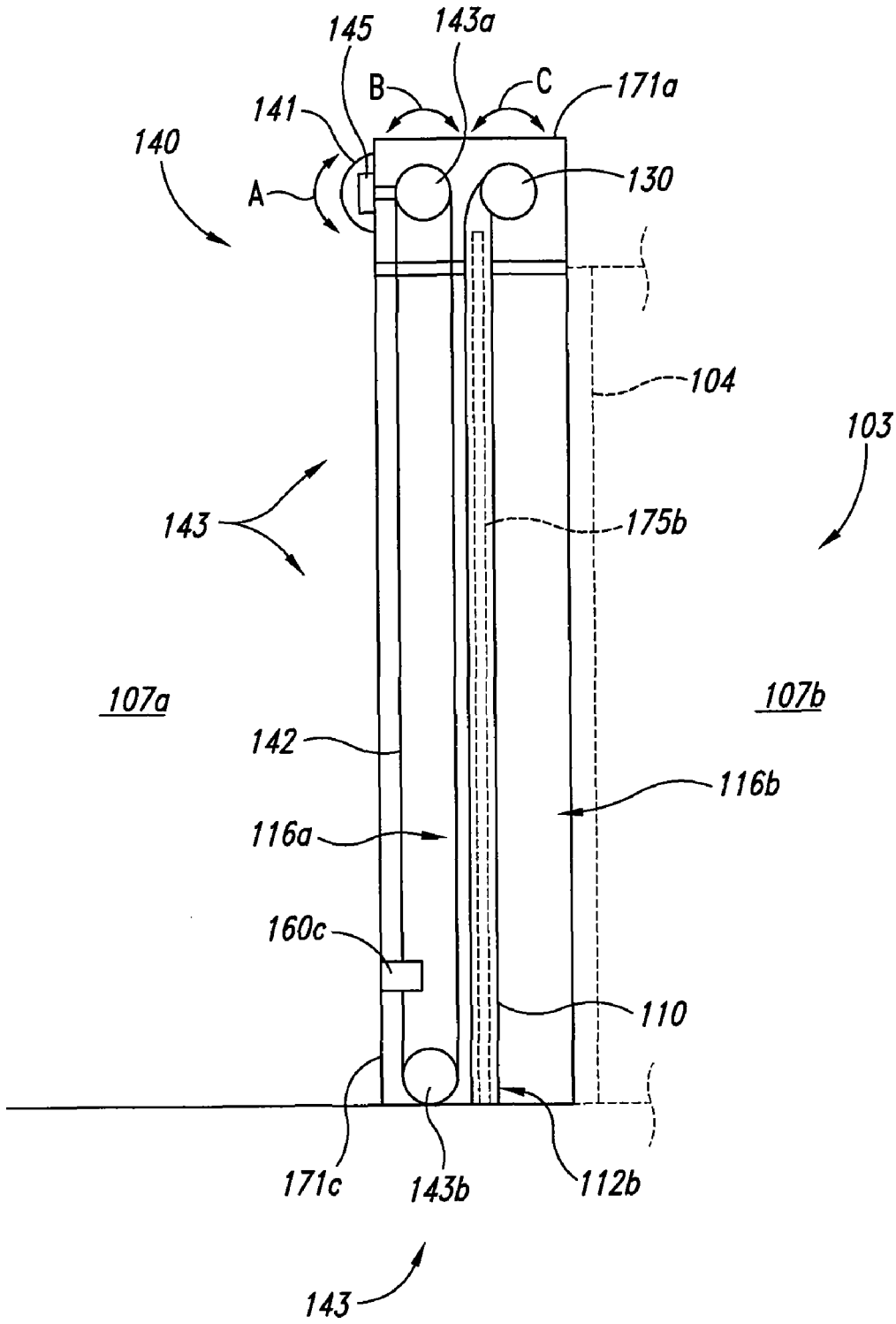
FIG. 5 is a partially schematic cross-sectional side elevation view of a portion of a drive assembly of the barrier system shown in FIG. 1.

Also as discussed above, in the illustrated embodiment the barrier 110 includes a first end 112*a* that is coupled to the spool 130, and a second end 112*b* that moves away from and toward the spool 130 as the barrier 110 moves toward the deployed position and the retracted position, respectively. Additionally, as shown in FIG. 2, the barrier 110 can also include a first edge or side 114*a* extending between the first end 112*a* and the second end 112*b*, and a second edge or side 114*b* at least approximately opposite the first side 114*a* and extending between the first end 112*a* and the second end 112*b*. Referring back to FIG. 3, the barrier 110 can also include a first surface 116*a* bounded, at least in part, by the first and second ends 112*a* and 112*b* and the first and second sides 114*a* and 114*b*. The barrier 110 can also include a second surface 116*b* at least approximately opposite the first surface 116*a*. In the illustrated embodiment, the second surface 116*b* is bounded, at least in part, by the first and second ends 112*a* and 112*b* and the first and second sides 114*a* and 114*b*. As shown in FIG. 5, the barrier system 100 in the illustrated embodiment is positioned so that the first surface 116*a* of the barrier 110 faces a first area 107*a* (e.g., a portion of the elevator lobby 105) and the second surface 116*b* of the barrier 110 faces a second area 107*b* away from the elevator lobby.

Figure 3A:
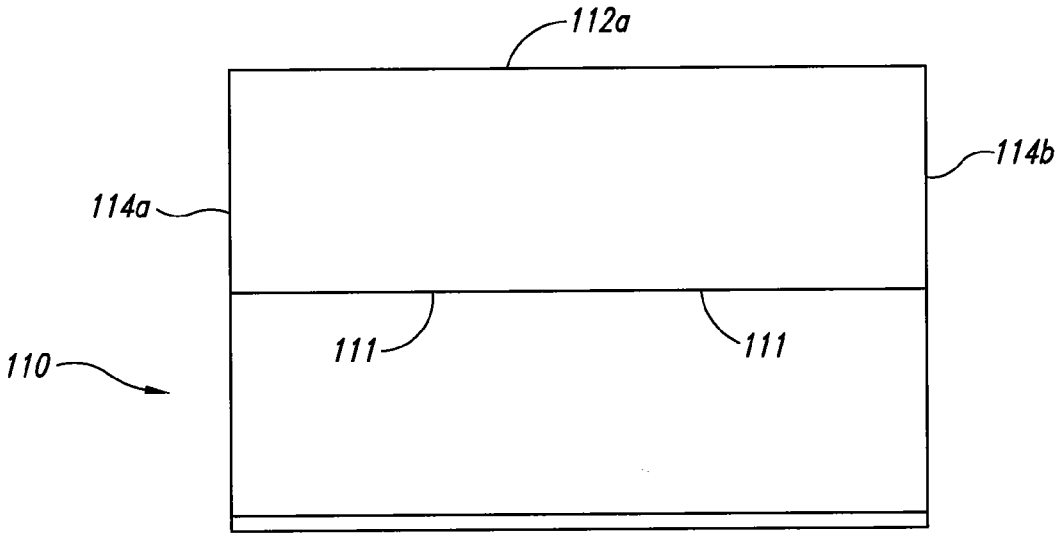
FIG. 3A is a partially schematic front elevation view of a portion of the barrier shown in FIG. 1.

In the illustrated embodiment, at least a portion of the barrier 110 has been formed from one or more sections of a flexible and foldable material coated and/or impregnated with PTFE. As shown in FIG. 3A, the sections of material have been joined together via a seam 111. For example, the sections can be joined together using a thermal or heat sealing process, stitching, welding, other joining mechanisms, and/or other joining methods. In FIG. 3A, the seam 111 runs at least approximately parallel to the first and second ends 112*a* and 112*b*. In selected embodiments, the seam running at least approximately parallel to the first and second ends 112*a* and 112*b* can facilitate portions of the barrier 110 winding smoothly onto the spool 130 with reduced bunching as compared to barriers having seams running at least perpendicular to the first and second ends 112*a* and 112*b*. Additionally, because in selected embodiments at least portions of the barrier material can be thin (e.g., 0.003-0.004 inches in thickness) and have low friction properties, the barrier system can use light duty components. Furthermore, because at least a portion of the barrier material can be thin, the barrier 110 can fit into a small volume when wound onto the spool.

In other embodiments the barrier can have other arrangements. For example, in selected embodiments the barrier can include more, fewer, or different sections and/or seams. For example, in certain embodiments the barrier 110 can include seams that are oriented differently with respect to the first and second ends. In other embodiments, the barrier 110 does not contain any seams.

In FIG. 3, the first end 112*a* of the barrier 110 includes a first coupling portion 119*a* configured to be coupled to the spool 130. In the illustrated embodiment, the first coupling portion 119*a* is formed by doubling over the barrier material to form a passageway though which a securing device 122 (e.g., a rod) can be inserted. In selected embodiments, the doubled over material forming the passageway can be sealed or secured using a thermal or heat sealing process, stitching, welding, other joining mechanisms, and/or other joining methods. The first coupling portion 119*a* can be inserted into a slot in the spool 130 and the securing device 122 can be inserted into the first coupling portion 119*a* that has been positioned in the interior of the spool 130. Because the securing device 122 is larger than the slot, the barrier 110 remains coupled to the spool 130. In certain embodiments where the barrier includes a PTFE material, the PTFE material can allow the securing device 122 to slide relative to the first coupling portion 119*a* and allow the first coupling portion 119*a* to slide relative to the spool 130 to reduce binding between these elements. In other embodiments, the first end 112*a* of the barrier 110 can be coupled to the spool 130 using other arrangements.

In the illustrated embodiment, the second end 112*b* of the barrier 110 includes a second coupling portion 119*b* coupled to a leading edge structure 120. In FIG. 3, the second coupling portion 119*b* is similar to the first coupling portion 119*a* and is coupled to the leading edge structure 120 using another securing device in a manner similar to that described above with reference to the first coupling portion 119*a* and the spool 130. In other embodiments, the second end 112*b* can have other arrangements.

In FIG. 3, the first sensor 160*a* is coupled to a portion of the leading edge structure 120 of the barrier 110 and positioned to impact a surface as the second end 112*b* of the barrier 110 moves toward the deployed position. For example, in the illustrated embodiment the first sensor 160*a* includes a first contact 161*a*, a second contact 162*a*, and a resiliently flexible cover 163*a*. In the illustrated embodiment, the cover is configured to hold the first and second contacts 161*a* and 162*a* apart unless a force is applied to move the contacts toward one another. Accordingly, in FIG. 3, if the first sensor 160*a* contacts the floor surface of the elevator lobby 105, or other surface as the barrier 110 moves toward the deployed position, the contacts 161*a* and 162*a* can be forced together.

When the contacts 161*a* and 162*a* touch, the first sensor 160*a* can send a signal to the control system indicating that the cover has been compressed. As discussed below in further detail, the control system can use this information, at least in part, to determine an appropriate command response. In the illustrated embodiment, the first sensor 160*a* is configured to send information to the control system using a wireless pathway 166. In other embodiments, the first sensor 160*a* can have other arrangements including other sensor components and/or other methods of communicating with the control system. For example, in other embodiments the first sensor 160*a* can include a non-wireless pathway that is carried, at least in part, by the barrier 110, the spool 130, the axles 131, and/or the housing assembly 170. In selected embodiments, the second end 112*b* of the barrier 110 and/or the first sensor 160*a* can be configured to at least partially seal with a surface 109 (shown in FIG. 1) when the barrier 110 is in the deployed position. For instance, the surface 109 can include a floor surface of the building, a portion of the housing assembly 170 that extends between opposing walls along a floor surface of the building, and/or another suitable surface. In selected embodiments the second end 112*b* of the barrier 110 and/or the first sensor 160*a* can include a flexible, moldable, and/or deformable material configured to deform against an irregular surface when the second end 112*b* of the barrier 110 is proximate to the surface 109 (e.g., when the barrier 110 is in, or near, the deployed position) to aid in creating an at least approximate seal between the barrier 110 and the surface 109.

Figure 4:
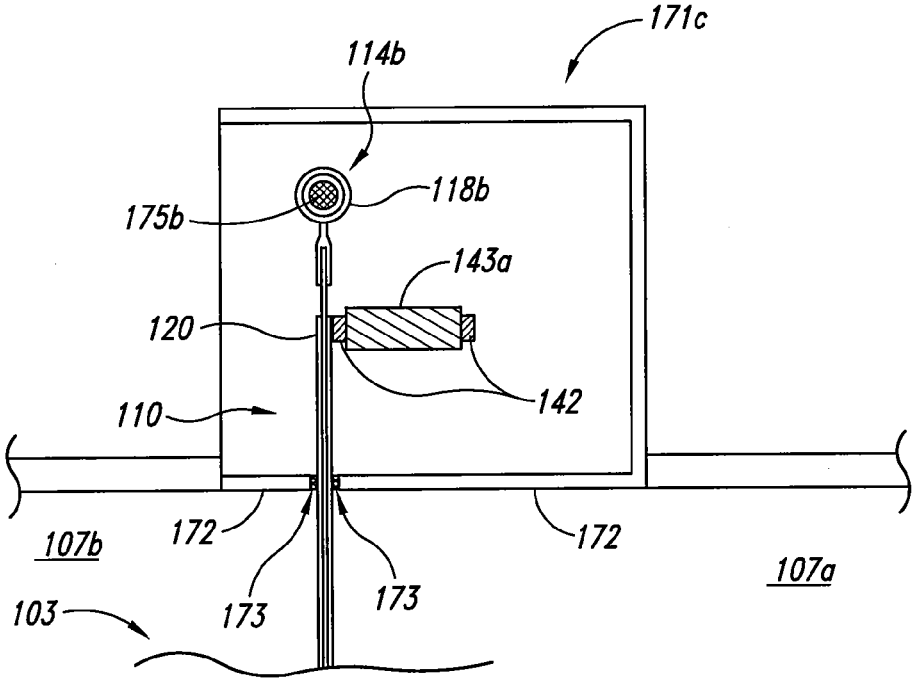
FIG. 4 is a partially schematic cross-sectional enlarged top view of a portion of a guide engagement portion of the barrier of the barrier system shown in FIG. 1.

Referring to FIGS. 2 and 4, the first side 114*a* of the barrier 110 includes at least one first guide engagement portion 118*a* and the second side 114*b* includes at least one second guide engagement portion 118*b*. In the illustrated embodiment, the barrier system also includes one or more guides 175, shown as a first guide 175*a* disposed in or adjacent to one of the elevator lobby's sidewalls and within the first side portion 171*b* of the housing assembly 170, and a second guide 175*b* disposed within or adjacent to the opposing sidewall and within the second side portion 171*c* of the housing assembly 170. In FIGS. 2 and 4, the first guide engagement portions 118*a* and 118*b* are configured to engage the one or more guides 175 so that the barrier 110 is guided along the guides 175 when the barrier 110 moves between the deployed and retracted positions.

For example, in FIG. 2 the guides 175 include poles or rails, and the guide engagement portions 118*a* and 118*b* include flexible looped material creating passageways along the sides 114*a* and 114*b* of the barrier 110 for receiving the poles (e.g., receiving elements). Sections of the engagement portions 118*a* and 118*b* slide over the poles as the barrier 110 is wound off and onto the spool 130. In addition to guiding the barrier 110 while the barrier moves between the deployed and retracted position, in selected embodiments the guide engagement portions and the guides can aid in keeping the sides of a flexible barrier properly positioned when the barrier is in the deployed position (e.g., to aid in reducing the migration of selected vapor(s) or fire around the barrier 110).

FIG. 4 is a partially schematic cross-sectional top view illustration of the second guide 175*b*, the second side portion 171*c* of the housing assembly 170, and a portion of the barrier 110. As shown in FIG. 4, in certain embodiments the second guide engagement portion 118*b* is flexible and can be coupled or bonded to other portions of the barrier 110 (e.g., using a heat sealing process). For example, in selected embodiments the second engagement portion 118*b* can be made from the same material as the rest of the barrier 110 (e.g., the material can be doubled over and coupled or bonded to other portions of the barrier 110 to form the engagement portion). In other embodiments, the second engagement portion 118*b* can be made from a different material. In still other embodiments, the second engagement portion 118*b* can have other arrangements. For example, in selected embodiments the second engagement portion 118*b* can be made by doubling over portions of barrier material to create a passageway as discussed above with reference to the first and second coupling portions 119*a* and 119*b*. In selected embodiments, a part of the second coupling portion 118*b* that contacts the second guide 175*b* can include a non-stick or slippery surface (e.g., such as a PTFE material) to help facilitate movement of the second coupling portion 118*b* relative to the second guide 175*b*. In other embodiments, the second guide 175*b* can include a non-stick or slippery material to facilitate movement between the second guide 175*b* and the second coupling portion 118*b*. In still other embodiments, the guides and/or the engagement portions can have other configurations. For example, in other embodiments the engagement portions can include rigid or semi-rigid loops or rings (e.g., with or without one or more bearing arrangements). In still other embodiments, the engagement portion and guide portion arrangement can include one or more linear bearings. In yet other embodiments, the guides can include a slot for receiving an engagement portion configured as a ridged portion on the side of the barrier.

In FIG. 4, the second side portion 171*c* of the housing assembly 170 is configured to resist the movement of vapor(s) and/or fire between the first area 107*a* and the second area 107*b* (shown in FIGS. 4 and 5) around the second side 114*b* of the barrier 110 when the barrier 110 is in the deployed position. For example, in the illustrated embodiment the second side portion 171*c* of the housing assembly 170 includes one or more sections 172 that enclose the side 114*b* of the barrier 110 and the second guide 175*b* with a small opening through which a portion of the barrier extends toward the first side 114*a* of the barrier 110. This small opening (e.g., a vertical slot) in combination with the barrier 110 and the rest of the second side portion 171*c* of the housing assembly 170 creates a torturous path for vapor(s) and/or fire to negotiate. Additionally, in selected embodiments one or more sealing elements 173 can further aid in resisting the penetration of vapor(s) and/or fire into and/or out of the second side portion 171*c* of the housing assembly 170. In certain embodiments these sealing elements 173 can include resilient blade-like materials that contact portions of the barrier 110. In other embodiments, the sealing elements 173 can have other arrangements. For example, in other embodiments the sealing elements can include foam, rubber, silicon, fabric, composite, plastic, and/or other materials and can be configured as wipers, brushes, blade seals, and/or the like. The first side portion 171*b* of the housing assembly 170 can be configured in a manner similar to that of the second side portion 171*c* of the housing assembly 170 to resist the migration of vapor(s) and/or fire when the barrier 110 is in the deployed position (e.g., wherein the migration is caused by a pressure differential between the first and second areas 107*a* and 107*b*).

Figure 6:
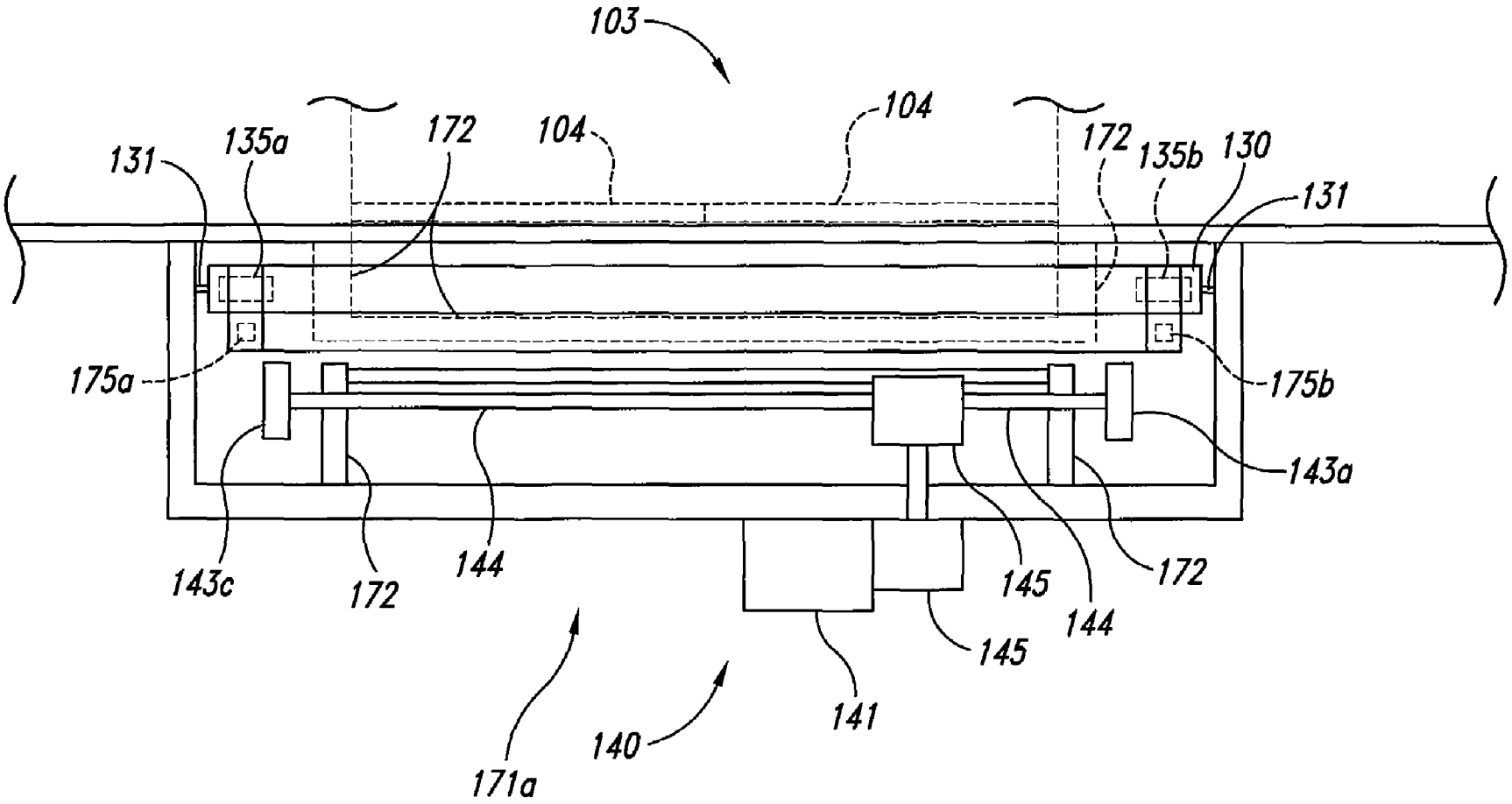
FIG. 6 is a partially schematic cross-sectional top view of a portion of the drive assembly of the barrier system shown in FIG. 1.

As shown in FIGS. 2 and 6, in selected embodiments the upper portion 171*a* of the housing assembly 170 can include similar sections 172 that create an opening (e.g., a horizontal slot) through which the barrier 110 can extend when the barrier is moved toward the deployed position. Accordingly, when the barrier 110 is in the deployed position, the upper portion 171*a* of the housing assembly 170 can create a torturous path for vapor(s) and/or fire to negotiate, thereby resisting the migration of vapor(s) and/or fire between the first area 107*a* and the second area 107*b* via the upper portion 171*a* of the housing assembly 170. In selected embodiments, one or more sealing elements similar to the sealing elements 173 shown in FIG. 4 can be used in, on, or with the upper portion 171*a* of the housing assembly 170 and/or on other portions of the housing assembly 170 to resisting the migration of vapor(s) and/or fire through the barrier system 100. For example, in selected embodiments a rubber or silicon blade seal or wiper can be positioned proximate to the barrier 110 and/or the spool 130 to prevent the migration of vapor(s) and/or fire through the upper portion 171*a* of the housing assembly 170, while allowing the barrier 110 to move between the deployed and retracted positions.

Accordingly, as discussed above, in selected embodiments the barrier system 100 can resist the migration of vapor(s) and/or fire between the first area 107*a* and the second area 107*b* when the barrier 110 is in the deployed position. For example, as discussed above, when the flexible barrier 110 is in the deployed position, the barrier and/or a sensor associated with the second end 112*b* of the barrier can at least approximately seal against the floor of the elevator lobby 105 and/or a surface of the structure. Additionally, portions of the housing assembly 170 in combination with the barrier 110 can resist the migration of vapor(s) and/or fire between the first area 107*a* and the second area 107*b*. Therefore, in certain embodiments the barrier system 100 can at least approximately seal the elevator lobby 105 and resist the migration of vapor(s) and/or fire between the first area 107*a* and the second area 107*b* when the flexible barrier 110 is in the deployed position.

FIG. 5 is a partially schematic cross-sectional side elevation view of a portion of the drive assembly 140 of the barrier system 100, and FIG. 6 is a partially schematic cross-sectional top view of a portion of the drive assembly 140. In the illustrated embodiment, the drive assembly 140 is configured to move the flexible barrier 110 relative to the elevator lobby 105 and/or relative to the housing assembly 170. In selected embodiments, the drive assembly 140 can include one or more motors 141, one or more belt devices 142, one or more rotational devices 143, one or more drive shafts 144, and one or more couplers 145. In the illustrated embodiment, the barrier system 100 includes two belt devices 142, one located within the first side portion 171*b* of the housing assembly 170 and one in the second side portion 171*c* of the housing assembly 170. The belt device 142 in the second side portion 171*c* of the housing 170 is shown in FIG. 5. In the illustrated embodiment, the second end 112*b* of the barrier 110 is coupled to the belt devices 142, for example, via one or more clamp devices, one or more coupling devices, and/or one or more fastener devices (shown as 124 in FIG. 7).

The belt devices 142 in the illustrated embodiment extend between rotational devices 143, such as a pulley, wheel, or other rotatable mechanism. For example, in FIG. 5 the belt device 142 located in the second side portion 171*c* is positioned on two rotational devices 143, shown as a first rotational device 143*a* located in the upper portion 171*a* of the housing assembly 170 and a second rotational device 143*b* located in the second side portion 171*c* of the housing assembly 170. The other belt device 142 located in the first side portion 171*c* is positioned in a similar manner on two rotational devices 143, including a third rotational device 143*c* located in the upper portion 171*a* of the housing assembly 170 and a fourth rotational device located in the first side portion 171*b* of the housing assembly 170.

As shown in FIG. 6, the first and third rotational devices 143*a* and 143*c* are coupled together by one or more drive shafts 144. The motor 141 is coupled to the one or more drive shafts 144 by one or more couplers 145 (e.g., 90 degree gearboxes). For example, in the illustrated embodiment the motor 141 can be located on an exterior portion of the housing assembly 170 and provides a rotational motion in the direction indicated by arrows A (shown in FIG. 5). The couplers 145 transmit the rotational motion from the motor 141 to the drive shaft(s) 144, which rotate or drive the first and third rotational devices 143*a* and 143*b* in the direction of arrows B (shown in FIG. 5). Accordingly, the motor 141 causes the drive shaft 144 to drive the rotational devices to move the belts. In the illustrated embodiment, the drive assembly drives the drive shaft 144, which is separate from the spool 130, and does not directly engage and drive the spool 130 to wind or unwind the barrier 110 for movement between the deployed and retracted positions. The rotational motion of the first and third rotational devices 143*a* and 143*b* rotate the belt devices 142 around their respective rotational devices moving the second end 112*b* of the barrier 110 toward and away from the spool 130. As the second end 112*b* of the barrier 110 moves toward and away from the spool, the spool can rotate in the direction of arrows C (shown in FIG. 5), with or against the urging force(s) of the resilient elements discussed above, thereby allowing the barrier 110 to wind off of and onto the spool 130. In the illustrated embodiment, the motor 141 is located on the exterior of the housing assembly 170 where it can be easily serviced and/or replaced.

Additionally, in selected embodiments the use of the one or more couplers 145 can allow the motor 141 to be positioned away from the axis/axes of the one or more shafts 144 and to be coupled to any portion of the one or more shafts 144 (e.g., the motor 141 can be coupled to the one or more shafts anywhere along the length of the one or more shafts). Furthermore, in other embodiments where the motor 141 provides rotational motion, the use of the one or more couplers 145 can allow the axis of rotation of rotational motion provided by the motor 141 to be substantially non-parallel to the axis/axes of rotation of the one or more shafts 144. In still other embodiments, the motor 141 can have other locations and/or can be coupled to one or more rotational devices in a different manner.

Figure 7:
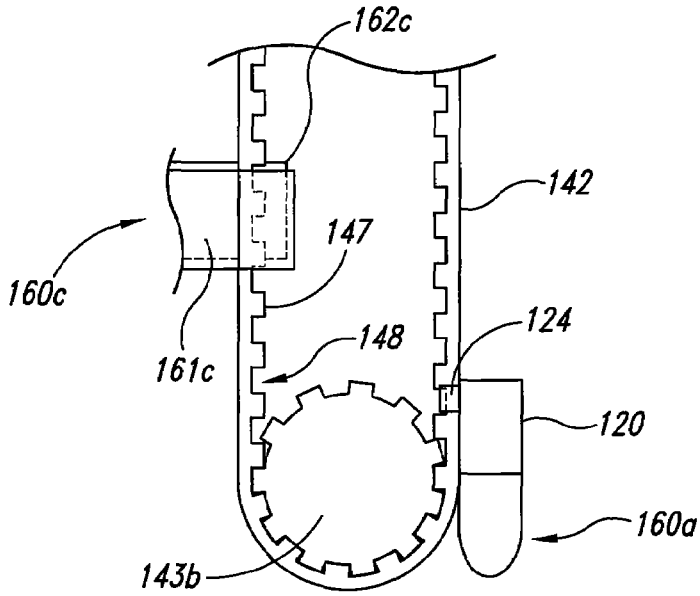
FIG. 7 is an enlarged partially schematic cross-sectional side elevation view of part of the portion of the drive assembly shown in FIG. 5.

FIG. 7 is an enlarged partially schematic cross-sectional side elevation view of the second rotational element 143*b*, a portion of the associated belt device 142 shown in FIG. 5, a portion of the leading edge structure 120, a part of the first sensor 160*a*, and a portion of the fastener device 124 (for the purpose of illustration other portions of the barrier system are not shown in FIG. 7). In FIG. 7, the belt devices include cog belts and the rotational elements include cogwheels. In other embodiments, the drive assembly 140 can have other arrangements, including more, fewer, and/or different components. For example, in other embodiments the belt devices can include other configurations such as chains, chords, cables, smooth belts, V-belts, and/or the like. In still other embodiments, the rotational devices can include other configurations such as gears, pulleys, structures that allow belt devices to rotate or slide around a center of rotation, and/or the like.

In still other embodiments, the drive assembly can have more or fewer rotational devices that are coupled to the motor by a drive shaft and/or coupler. While in the illustrated embodiment, the motor includes an electrical motor, in other embodiments the motor can include other types of motors (e.g., pneumatic motors and/or other types of motion generation devices). For example, in other embodiments the motor can include a gravity type motor that uses a counter weight that is dropped to provide motive force to move the barrier.

Figure 8:
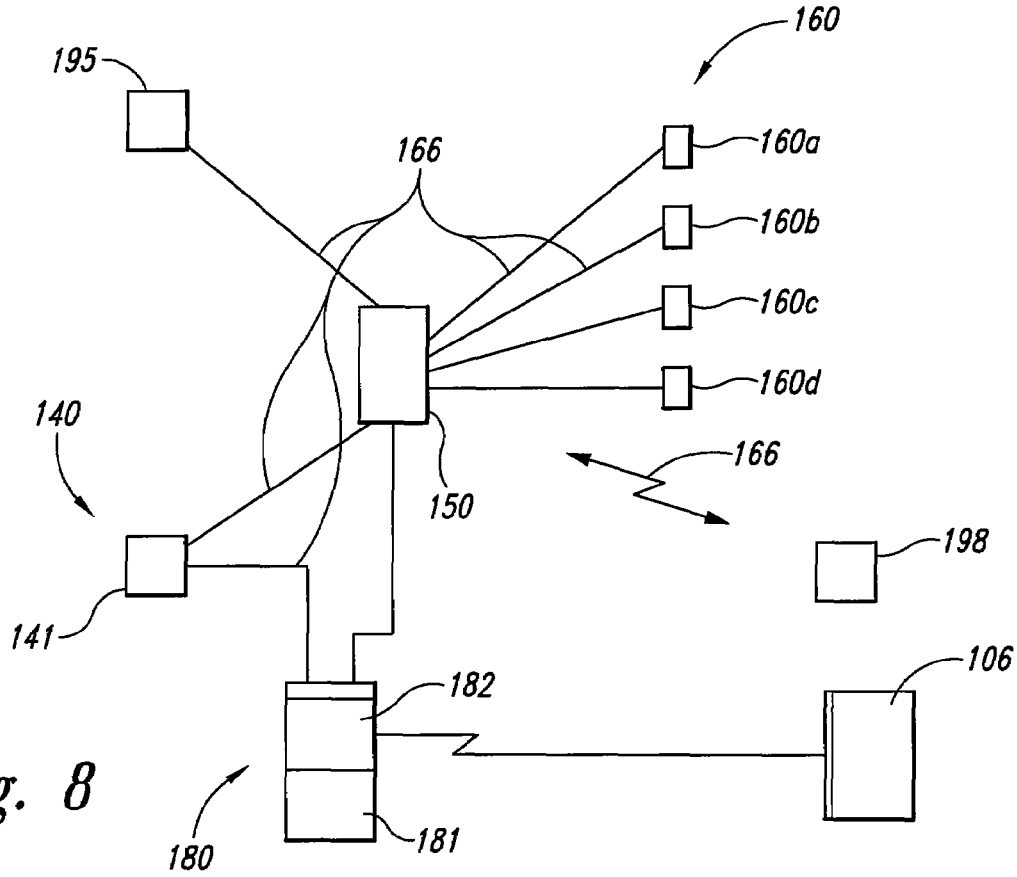
FIG. 8 is a partially schematic illustration of a portion of a control system and a power supply of the barrier system shown in FIG. 1.
Figure 9:
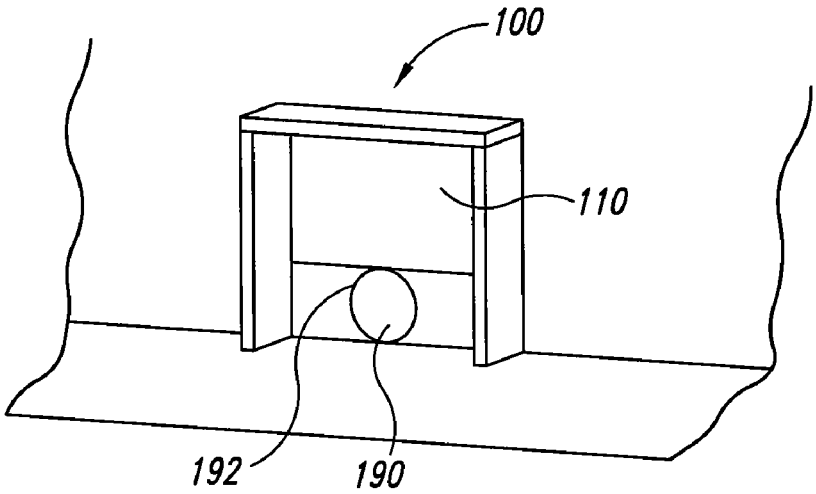
FIG. 9 is an isometric illustration of the barrier system shown in FIG. 1 and an object in accordance with embodiments of the invention.

FIG. 8 is a partially schematic illustration of a portion of a control system 150 and a power supply 180 of the barrier system 100 shown in FIG. 1. As discussed above, in the illustrated embodiment the control system is operably coupled to a portion of the drive assembly 140 (e.g., the motor 141), to one or more sensors 160, and to the external device 195 via pathways 166. Additionally, in FIG. 8 the control system 150 and drive assembly 140 are coupled to the power supply 180 via additional pathways 166. In the illustrated embodiment, the power supply is configured to supply electrical power to operate portions of the drive assembly 140 (e.g., the motor 141) and to operate portions of the control system 150.

In FIG. 8, the power supply 180 is coupled to an external power source 106 (e.g., a public power grid, a generator supplying power to a structure, and/or the like). In the illustrated embodiment, the external power source 106 supplies alternating current (e.g., 120V-240V, 50 Hz-60 Hz) to the power supply 180. In FIG. 8, the power supply 180 includes a transformer rectifier 182 for converting alternating current ("AC") to direct current ("DC") and supplies DC to various barrier system components. In other embodiments, the external power source 106 can supply other types of power and/or the power supply 180 can have other configurations.

Additionally, in the illustrated embodiment the power supply includes one or more battery units 181 (e.g., including among other things one or more batteries and/or one or more battery chargers) and the DC from the transformer rectifier 182 can provide power to the battery charger unit(s) to charge the one or more batteries. The one or more battery units 181 can be configured to provide a battery backup feature by supplying power to the barrier system 100 in the event of an external power source failure. In selected embodiments, the power supply 180 (including the battery backup feature) can be used to provide power to other components associated with the barrier system 100. For example, in certain embodiments the barrier system 100 can supply power to the external device 195 from the power supply 180, for example, in the event of a power failure that affects the external device 195.

In other embodiments, the power supply can have other arrangements. For example, in selected embodiments the power supply 180 can be configured to provide both DC and AC power (e.g., via a by-pass circuit with fault protection) to the barrier system 100 and/or other components associated with the barrier system 100. In other embodiments the barrier system 100 does not include a power supply and portions of the barrier system are coupled directly to the power source 106. Although in the illustrated embodiment the power supply is carried in the housing assembly 170 (shown in FIG. 1), in other embodiments the power supply can be carried in other locations and/or can be remotely located.

As discussed above, in the illustrated embodiment the control system 150 includes a computer or computing system configured with instructions to enable and control movement of the barrier. Additionally, in selected embodiments the control system 150 can perform other functions, including supplying electrical power to other components (e.g., the control system 150 can supply power from the power supply 180 to the sensors 160 and/or the external device 195), monitoring various barrier system components, monitoring external devices, and/or calibrating various components associated with the barrier system. For example, in certain embodiments the control system 150 can command the drive assembly 140 to enable movement or to move the barrier toward the deployed and retracted position based on the information provided by the external device 195 and/or the one or more sensors 160.

For instance, as discussed above, in selected embodiments where the external device 195 includes a smoke or fire alarm/detector, the control system 150 can be configured to command the drive assembly 140 to enable movement of the barrier 110 toward the deployed position when the detector senses fire, smoke, and/or other types of selected vapor(s) (e.g., is in the second state). The control system 150 can also be configured to command the drive assembly 140 to enable movement of the barrier 110 toward the retracted position when the detector does not sense fire, smoke, or selected vapor(s) (e.g., is in the first state), and the barrier 110 is not in the retracted position. Accordingly, the control system 150 can be configured with instructions to deploy the barrier 110 when a vapor and/or fire event is sensed (e.g., when the barrier 110 is not in the deployed position) and retract the barrier 110 when the vapor and/or smoke event has cleared.

Additionally, the control system 150 can use information provided by the one or more sensors 160 to determine the appropriate command(s) to provide to the drive assembly 140. For example, as discussed above, in selected embodiments the first sensor can 160*a* can be configured to sense when the leading edge structure 120 of the second end 112*b* of the barrier 110 contacts, or is proximate to, a surface, for example, as the barrier 110 is moving toward the deployed position. The second and third sensors 160*b* and 160*c* can be positioned proximate to the barrier 110 and configured to sense the position of the barrier 110. For example, in the illustrated embodiment the second and third sensors 160*b* and 160*c* are positioned proximate to the belt devices 142, which are coupled to the barrier 110. Accordingly, the second and third sensors 160*b* and 160*c* sense the position of the barrier 110 indirectly by sensing the position of the belt devices 142.

For example, FIG. 7 shows the third sensor 160*c*, which in the illustrated embodiment is configured as an optical sensor. In FIG. 7, the third sensor 160*c* includes a first portion 161*c* that emits electromagnetic energy (e.g., a selected frequency of light) and a second portion 162*c* that is configured to receive the emitted electromagnetic energy. The first and second portions 161*c* and 162*c* of the third sensor 160*c* can be positioned so that the cogs or teeth 147 of the belt device 142 intermittently block the second portion 162*c* from receiving the emitted electromagnetic energy as the belt device 142 rotate around the associated rotational devices 143. Accordingly, the spaces 148 between the teeth 147 allow the second portion 162*c* to intermittently receive the emitted electromagnetic energy as the belt device 142 rotates around the associated rotational devices 143. Therefore, the third sensor 160*c* and/or the control system 150 can "count" the teeth as the belt device 142 rotates and can determine the position of the portion of the barrier 110 that is coupled to the belt device 142. The second sensor 160*b* can be configured to operate in combination with the other belt device 142 in a manner similar to that of the third sensor 160*c*.

In selected embodiments, the control system 150 can determine the direction the barrier 110 is moving, and therefore the direction that the teeth 147 are moving, based on the direction the control system 150 commanded the drive assembly to move. In other embodiments, the control system 150 and/or third sensor 160*c* can determine the direction the teeth 147 are moving by determining which part of the second portion 162*c* is blocked first by the teeth 147 or cogs on the belt as the belt device rotates 142 (e.g., the top or bottom of the second portion 162*c* of the third sensor 160*c*). In selected embodiments, the control system 150 can compare the movement of the teeth 147 past the second and third sensors 160*b* and 160*c* to sense whether the barrier system is being deployed or retracted asymmetrically, for example, due to a cog belt slipping on a cogwheel. In other embodiments, the third sensor 160*c* can have other arrangements and/or can be positioned in other locations. For example, although in FIG. 7 the third sensor 160*c* is located proximate to the second rotational device 143*b*, in other embodiments the third sensor 160*c* can be positioned proximate to the first rotational device 143*a* or anywhere between the first and second rotational devices 143*a* and 143*b*.

In FIG. 8, the fourth sensor 160*d* is positioned to sense when the second leading edge 112*b* of the barrier 110 is at least approximately in the retracted position. For example, in the illustrated embodiment the fourth sensor 160*d* is located within the upper portion 171*a* of the housing assembly 170 (shown in FIG. 1) and positioned to sense when the barrier 110 reaches the retracted position. For example, in selected embodiments the fourth sensor 160*d* can include a contact or proximity switch that the leading edge structure 120 of the barrier 110 triggers when the barrier 110 is proximate to the retracted position. Accordingly, when drive assembly 140 is moving the barrier 110 to the retracted position based on a command from the control system 150 and the fourth sensor 160*d* senses that the barrier 110 has reached the retracted position, the control system can command the control system 150 to cease movement of the barrier 110. In certain embodiments, the drive assembly 140 can be configured to retain the barrier 110 until the control system 150 commands further movement of the barrier 110.

For example, in selected embodiments the drive assembly can resist being back-driven so that the drive assembly 140 resists movement when the control system 150 is not commanding movement of the barrier and/or when power is removed from the drive assembly 140. For example, in selected embodiments the motor 141 can include a motor that resists being back-driven. In other embodiments, the drive assembly 140 can include various latch components (e.g., controlled by the control system 150) that prevent movement of the barrier until the latch components are released. In still other embodiments, the position of the barrier 110 provide by the second and third sensors 160*b* and 160*c* can be used in addition to, or in lieu of, the fourth sensor 160*d* to determine when the barrier 110 is at least approximately in, or nearing, the retracted position.

As discussed above with reference to FIGS. 1 and 3, in selected embodiments the first sensor 160*a* can be configured and positioned to sense when the second end 112*b* of the barrier 110 is proximate to a surface (e.g., when the second end 112*b* is near or contacts a surface). For example, in one embodiment the drive assembly 140 can move the barrier toward the deployed position based on command(s) received from the control system 150 and the control system 150 can use inputs from the first sensor 160*a* and/or the second and third sensors 160*b* and 160*c* to determine when the barrier 110 is in the deployed position. The control system 150 can then command the drive assembly to stop movement of the barrier 110. For example, as the barrier 110 moves toward the deployed position, the control system 150 can receive an input from the first sensor 160*a* indicating that the first sensor 160*a* positioned on the second end 112*b* of the barrier 110 has contacted a surface. Additionally, the control system 150 can receive input from the second and third sensors 160 indicating that the barrier 110 is at least approximately in the deployed position. Accordingly, the control system 150 can determine that the barrier is in the deployed position and command the drive assembly 140 to stop movement and/or to retain the barrier 110 in the deployed position. In other embodiments, more, fewer, and/or different sensors can be used to determine the position of the barrier or determine when the barrier is in another selected position.

In other embodiments, when the drive assembly 140 is moving the barrier 110 toward the deployed position and the first sensor 160*a* senses the proximity of a surface 192 of an object 190 (shown in FIG. 9) prior to the second and third sensors 160*b* and 160*c* sensing that the barrier 110 is at least approximately in the deployed position, the control system 150 can be configured to command the drive assembly 140 to stop the movement of the barrier 110. For example, in certain embodiments when the first sensor 160*a* contacts the surface 192 and the barrier 110 is not at least approximately in the deployed position, the control system 150 can be configured with instructions to stop the barrier 110 and enable movement of the barrier 110 toward the retracted position. In selected embodiments, once the barrier 110 reaches the retracted position, the control system 150 can be configured with instructions to enable movement of the barrier 110 toward the deployed position (e.g., a second attempt at moving the barrier toward the deployed position). In certain embodiments, if the first sensor 160*a* senses the proximity of the surface 192 (or another surface) prior to the barrier 110 reaching at least approximately the deployed position during the second attempt, the control system 150 can be configured with instructions to command the drive assembly 140 to stop the movement of the barrier 110, for example, with the first sensor 160*a* touching the surface 192. If the first sensor 160*a* later senses that the first surface 192 has been removed or is not longer proximate to the first sensor 160*a*, the control system 150 can be configured with instructions to enable movement of the barrier 110 toward the deployed position.

In other embodiments, the control system 150 can include other control logic. For example, in other embodiments once the obstruction is removed during a second deployment attempt, the control system 150 can enable movement of the barrier toward the retracted position before moving the barrier toward the deployed position. In other embodiments, if a sensor senses an obstruction preventing the barrier 110 from reaching the deployed position during an initial deployment, the barrier 110 can be held in an intermediate position (e.g., with the second end 112*b* of the barrier proximate to the obstruction).

In still other embodiments, the control system 150 can be configured with instructions for performing other functions and/or with other control logic. For example, in selected embodiments the control system 150 can be configured to perform monitoring, backup, and/or calibration functions. For instance, in selected embodiments the control system 150 can be configured to monitor the health of various components associated with the barrier system and/or report the status of various components associated with the barrier system to other systems 198 (shown in FIG. 8).

For example, in selected embodiments the control system 150 can monitor components associated with the barrier system that are external to the barrier system including the power source 106 and the external device 195. For instance, in selected embodiments the control system 150 can monitor the external device 195 by sending a signal to the external device 195 and/or receiving a signal from the external device 195. The signal(s) can be used to determine whether the external device 195 is connected to the barrier system via pathway(s) 166, whether the external device is powered, whether the external device has a fault (e.g., is malfunctioning), what fault(s) the external device has experienced, and/or the like.

In other embodiments, the control system 150 can monitor other barrier system components, including components that comprise the barrier system itself. For example, in certain embodiments the control system 150 can monitor the health of the sensor(s) 160, the power supply 180, the drive assembly 140, and/or the various pathways 166. For example, in selected embodiments the control system 150 can send and/or receive signals to determine battery charge state(s), whether the battery charging unit(s) is/are working, whether one or more batteries have over heated, and/or the like. In other embodiments, the control system can monitor various components for an over load condition. For example, in selected embodiments the control system 150 can include a sensor and/or circuit protection device (e.g., fuse or circuit breaker) that will disconnect power to the motor in the drive assembly if the motor draws too much electrical current. In still other embodiments the control system 150 can be configured with logic to use the sensor(s) 160 to determine whether a portion of the barrier system has jammed, whether the barrier has experienced an asymmetry, whether the barrier has deployed in response to a barrier deployment command, and/or the like.

In selected embodiments, the control system can be configured to take corrective action in the event that a component associated with the barrier system is malfunctioning. For example, in selected embodiments the control system can be configured to shut down one or more battery chargers in the event that one or more batteries are overheating. Additionally, in certain embodiments the control system 150 can be configured to provide a user or operator with a status of the barrier system or components associated with the barrier system on a barrier system display or to send the status to another system 198 (e.g., a central building monitoring system). This status can include the health of components associated with barrier system components and/or other information, for example, whether a barrier deployment has been commanded by the control system and/or whether an external device 195 configured as a smoke/fire detector has sensed smoke/fire. In selected embodiments, the other system 198 can be configured to provide inputs to the control system. For example, in one embodiment the other system 198 can be configured allow a user to command the control system 150 to deploy the barrier.

In certain embodiments, the control system 150 and/or the power supply 180 can be configured to provide various backup functions. For example, in selected embodiments the battery unit(s) 181 of the power supply 180 can provide electrical power to other components associated with the barrier system in the event of a loss of power from the power source 106. For instance, the battery unit(s) 181 can provide power to the control system 150, the sensor(s) 160 and/or portions of the drive assembly 140 so that the barrier system can continue to operate with the loss of power from the power source 106. Additionally, in certain embodiments, the battery unit(s) 181 can provide power to the external device 195 if the external device 195 does not have its own power back up. In still other embodiments, the control system 150 can display and/or send a status to another system 198 indicating that power from the power source 106 has been lost.

In selected embodiments, the control system 150 can be configured with instructions to perform one or more calibration functions. For example, in certain embodiments once the barrier system is installed a user can insure that there are no obstructions proximate to the barrier and command the control system 150 to initiate a calibration process. The control system 150 can then enable movement of the barrier through a sequence of positions so that the control system 150 can use the second and third sensors 160*b* and 160*c* to determine the barrier position based on the movement of the cog belt (e.g., by counting teeth). For instance, in one embodiment the control system 150 can command the barrier toward the retracted position. The fourth sensor 160*d* can sense when the barrier has reached the retracted position and the control system 150 can command the drive assembly 140 to stop movement of the barrier. The control system 150 can then command the drive assembly 140 to move the barrier toward the deployed position and record the number of teeth on the cog belts that pass the second and third sensors 160*b* and 160*d* until the first sensor 160*a* senses that the barrier has reached the deployed position. Using this data, the control system 150 can subsequently monitor the movement of the teeth on the cog belt via the second and third sensors 160*b* and 160*c* to determine the position of the barrier, for example, when the barrier is at least approximately in the retracted position, at least approximately in the deployed position, not in the deployed position, not in the retracted position, and/or the like.

In other embodiments, the control system 150 can have different calibration functions/features or can calibrate other components. For example, in other embodiments a user or operator can interface with the control system 150 during the calibration process. For example, in certain embodiments a user can use a control system control panel to command movement of the barrier and can manual indicate when the barrier is in selected position. The control system 150 can track the movement of the teeth on the belt cog between the selected positions and use this information to determine the position of the barrier during subsequent operation.

In other embodiments, the barrier system can have other arrangements. For example, in other embodiments the barrier system can have more sensors, fewer sensors, and/or different types of sensors. In still other embodiments, the sensors can be used by the control system in other ways and/or sensors can be positioned to sense other characteristics associated with the barrier (e.g., other positional information, rate information, and/or the like). Additionally, although in the illustrated embodiment the second end of the barrier is shown moving in vertical plane between the retracted and deployed positions in other embodiments the barrier system can have other orientations. For example, in selected embodiments the second end of the barrier can move in a horizontal plane between the retracted and the deployed positions. Additionally, although in the illustrated embodiment the barrier is made from a flexible material, in other embodiments the barrier can have other configurations. For example, in other embodiments at least a portion of the barrier can have rigid or semi-rigid segments or portions. Furthermore, although in the illustrated embodiment the barrier system is shown associated with a structure that includes a building, in other embodiments the barrier system can be associated with other structures. For example, in one embodiment the barrier system is positioned to cover an opening in a vehicle such as a ship.

Figure 10:
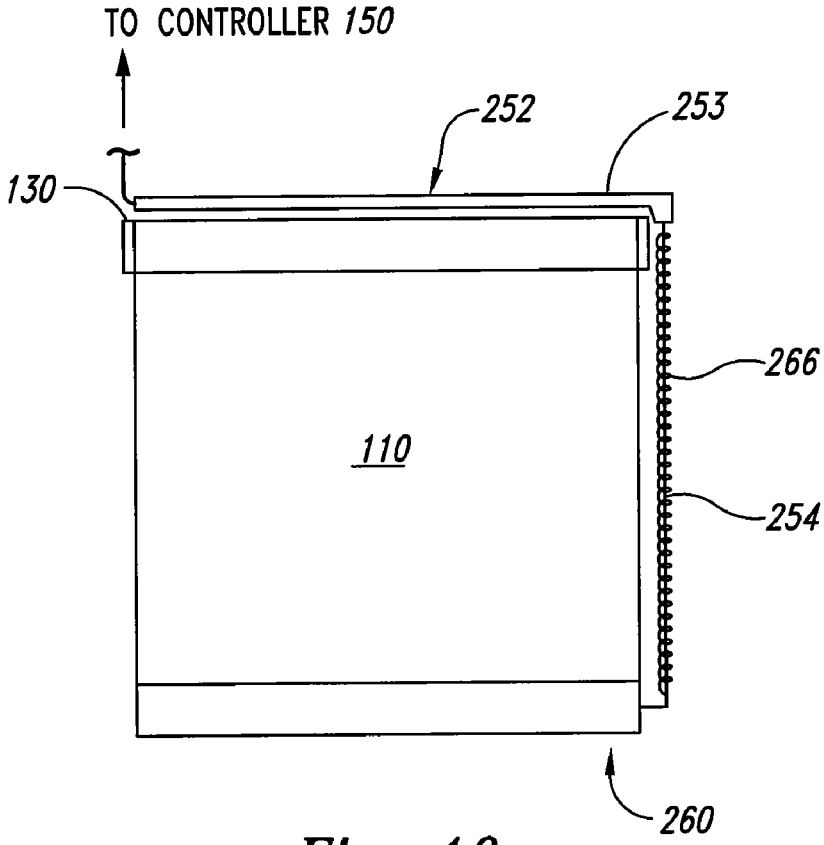
FIG. 10 is a partially schematic front elevation view of a pathway retention device in accordance with selected embodiments of the invention.

In still other embodiments, the barrier system can include a pathway retention device 252 as shown in FIG. 10 for retaining, supporting, and/or organizing one or more pathways 266 associated with the barrier system. In FIG. 10, the first sensor shown in FIG. 1 has been replaced with a fifth sensor 260. The fifth sensor 260 is operably coupled to the controller 150, shown in FIG. 8, via one or more pathways 266. For example, in FIG. 10 the one or more pathways 266 are configured to carry communication signals between the controller 150 and the fifth sensor 260, and to supply electrical power to the fifth sensor 260 (e.g., directly from the power supply and/or via the controller 150). For instance, in selected embodiments the one or more pathways 266 can include one or more electrical wires and/or one or more fiber optic cables.

In FIG. 10, pathway(s) 266 are positioned proximate to the barrier 110 so that the pathway(s) can remain operably coupled between the fifth sensor and the controller and/or the power supply as the barrier 110 moves between the retracted and deployed positions. In the illustrated embodiment, the pathway retention device 252 includes a support structure 253 positioned proximate to the spool 130 (e.g., within the housing of the barrier system) and configured to support at least a portion of the pathway(s) 266. Note that for the purpose of illustration, other barrier system components are not shown in FIG. 10. In FIG. 10, the support structure 253 is configured to provide a housing or container within which at least a portion of the pathway(s) 266 can be contained or retained. Additionally, in selected embodiments at least a portion of the pathway(s) 266 can be retracted into and/or extend out of the support structure 253 as the barrier 110 moves between the deployed and retracted positions, keeping the pathway(s) 266 organized and clear of the movement of other barrier system components.

For example, in the illustrated embodiment the one or more pathways 266 are configured to have a resilient characteristic. For example, the pathway(s) 266 can be configured to have a coiled rest position similar to that of a coiled telephone cord that extends between a telephone base and headset. Accordingly, as the pathway(s) 266 are required to be lengthened (e.g., as the barrier in the illustrated embodiment moves toward the deployed position), the pathway(s) 266 can extend or stretch the coils from their rest position to an extended position. Additionally, in selected embodiments as the coils of the pathway(s) 266 are stretched, a portion of the pathway(s) 266 being carried in the support structure 253 can be pulled or extended from the support structure 253. Conversely, when the length requirement of the pathway(s) 266 is reduced (e.g., as the barrier in the illustrated embodiment moves toward the retracted position), the coils of the pathway(s) 266 can tend to return toward their rest position. In selected embodiments, this tendency to return toward the rest position can urge a portion of the pathway(s) 266 to retract into or gather inside the support structure 253.

Figure 11:
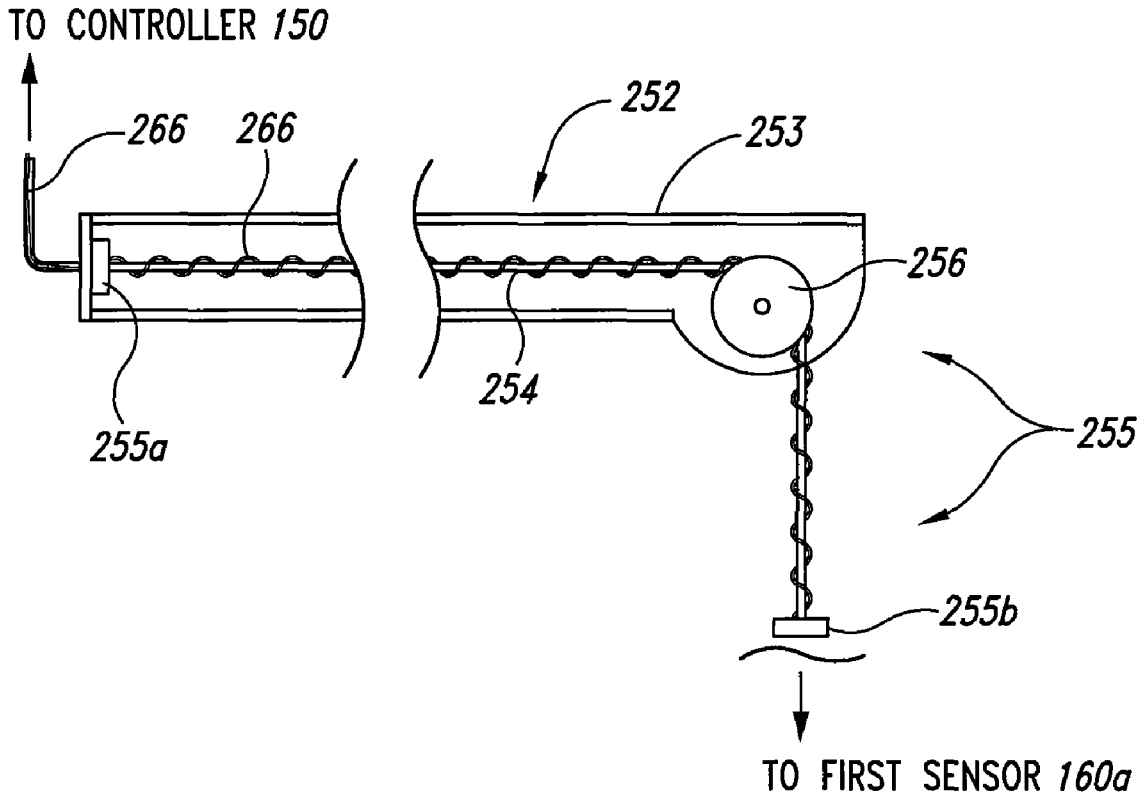
FIG. 11 is a partially schematic cross-sectional front elevation view of a portion of the pathway retention device shown in FIG. 10.

Additionally, in the illustrated embodiment the pathway retention device 252 includes a forcing element 254 to aid in urging the pathway(s) 266 in retracting or shortening and/or to urge at least a portion of the pathway(s) 266 to retract into the support structure 253. For example, in selected embodiments the forcing element 254 can include a bungee cord, surgical tubing, and/or other materials having an elastic or resilient characteristic that causes the material to have a tendency to return to a rest position. For example, as shown in FIG. 11, in one embodiment the forcing element 254 includes surgical tubing. The forcing element 254 can be coupled to the pathway(s) 266 via retention elements 255. For example, a first retention element 255*a* can be coupled to the support structure 253, a first portion of the pathway(s) 266, and a first portion or end of the forcing element 254. A second portion of the pathway(s) 266 can be coupled to a second portion or end of the forcing element 254 via a second retention element 255*b*. The first and second retention elements 255*a* and 255*b* can be positioned so that the forcing element 254 is in a first position that is closer to its rest position when the length requirement of the pathway(s) 266 is reduced (e.g., the barrier is in the retracted position) and in a second position that is further from its rest position when the length requirement of the pathway(s) 266 is increased (e.g., the barrier is in the deployed position). Accordingly, the forcing element 254 can provide an urging force to the pathway(s) to cause the pathway(s) to retract into the support structure 253 when the length requirement of the pathway(s) is reduced.

In certain embodiments, the pathway retention device 252 can include other components. For example, in FIG. 11, the pathway retention device 252 can include one or more guide elements 256. In FIG. 11, the guide element 256 includes a pulley type device that aids in allowing the pathway(s) 266 in making an at least approximately 90 degree bend while at least a portion of the pathway(s) 266 moves into and out of the support structure 253. In other embodiments, the guide element 256 can have other configurations. For example, in selected embodiments the guide element 256 can include a low friction surface, a bearing arrangement, a race, a mechanical guide, and/or the like.

In other embodiments the barrier system and/or the pathway retention device can have other arrangements. For example, in other embodiments the barrier system can include more or fewer pathway retention devices. In still other embodiments, the pathway(s) do not include a resilient characteristic and/or the pathway retention device does not include a forcing element. In yet other embodiments, the support structure of the pathway retention device is located proximate to the surface that the second end of the barrier is proximate to when the barrier is in the deployed position, and the pathway(s) extend from the support structure as the barrier move toward the retracted position and retracts into the support structure as the barrier moves toward the deployed position.

The above-detailed embodiments of the invention are not intended to be exhaustive or to limit the invention to the precise form disclosed above. Specific embodiments of, and examples for, the invention are described above for illustrative purposes, but those skilled in the relevant art will recognize that various equivalent modifications are possible within the scope of the invention. For example, whereas steps are presented in a given order, alternative embodiments may perform steps in a different order. The various aspects of embodiments described herein can be combined and/or eliminated to provide further embodiments. Although advantages associated with certain embodiments of the invention have been described in the context of those embodiments, other embodiments may also exhibit such advantages. Additionally, not all embodiments need necessarily exhibit such advantages to fall within the scope of the invention.

Unless the context clearly requires otherwise, throughout the description and the claims, the words "comprise," "comprising," and the like are to be construed in an inclusive sense as opposed to an exclusive or exhaustive sense, i.e., in a sense of "including, but not limited to." Additionally, the words "herein," "above," "below," and words of similar import, when used in this application, shall refer to this application as a whole and not to any particular portions of this application. Use of the word "or" in reference to a list of items is intended to cover a) any of the items in the list, b) all of the items in the list, and c) any combination of the items in the list.

In general, the terms used in the following claims should not be construed to limit the invention to the specific embodiments disclosed in the specification unless the above-detailed description explicitly defines such terms. In addition, the inventors contemplate various aspects of the invention in any number of claim forms. Accordingly, the inventors reserve the right to add claims after filing the application to pursue such additional claim forms for other aspects of the invention.

We claim:

1. A barrier system, comprising:

a barrier having a first end and a second end;

a spool coupled to the first end of the barrier, the barrier being positioned to be wound onto and off of the spool;

an electrical component at the second end of the barrier;

a drive assembly coupled to the second end of the barrier and configured to enable movement of the second end of the barrier toward and away from the spool as the barrier is wound onto and off of the spool; and a resilient line between the electrical component and the drive assembly at least partially housed by a support structure and configured to convey signals between the electrical component and the drive assembly, the resilient line being further configured to extend from the support structure when the barrier is wound off of the spool and to retract into the support structure when the barrier is wound onto the spool.

2. The system of claim 1, further comprising a housing assembly proximate to the barrier, the spool being coupled to the housing assembly to rotate about a fixed axis, the spool being configured to rotate as the barrier is wound onto and off of the spool.

3. The system of claim 1 wherein the barrier is made from a flexible material.

4. The system of claim 1 wherein the barrier is at least one of a smoke barrier and a fire barrier.

5. The system of claim 1 wherein the drive assembly includes a belt device, at least one rotational device, and a motor, the second end of the barrier being coupled to the belt device.

6. The system of claim 1 wherein the drive assembly includes a drive shaft, a drive motor connected to the drive shaft, and a transmission device interconnecting the drive shaft to the second end of the barrier, wherein the drive shaft and transmission device are independent of the spool.

7. The system of claim 1 wherein the drive assembly includes a motor positioned away from the axes of rotation of the spool.

8. The system of claim 1, further comprising a guide configured to guide at least a portion of the barrier as the barrier winds onto and off of the spool.

9. The system of claim 1 wherein the barrier includes a first side and a second side at least approximately opposite the first side, the first side extending between the first end and the second end, the second side extending between the first end and the second end, the first side including a first guide engagement portion and the second side including a second guide engagement portion, and wherein the system further includes a first guide and a second guide, at least a portion of the first guide configured to guide at least part of the first guide engagement portion as the second end of the barrier moves toward and away from the spool, and at least a portion of the second guide configured to guide at least part of the second guide engagement portion as the second end of the barrier moves toward and away from the spool.

10. The system of claim 1 wherein the spool is coupled to a resilient element having a rest position, the resilient element being configured so that when the resilient element is displaced away from the rest position the resilient element has a tendency to return to the rest position, the spool being coupled to the resilient element so that when the barrier is wound off of the spool the resilient element is displaced away from the rest position to urge the spool to rotate to wind the barrier onto the spool.

11. The system of claim 1 wherein the drive assembly is configured to enable movement of the second end of the barrier toward the spool to a retracted position and away from the spool to a deployed position, and wherein the system further comprises a housing assembly positioned proximate to the barrier so that when the barrier is in the deployed position the barrier and the housing assembly block at least a portion of a passageway in a structure and when the barrier is in the retracted position the portion of the passageway is unblocked.

12. A barrier system, comprising:

a barrier movable between a deployed position and a retracted position;

a drive assembly coupled to the barrier to enable movement of the barrier between the deployed and retracted positions;

a control system coupled to the drive assembly and configured to command operation of the drive assembly;

a sensor operably coupled to the control system and positioned to sense barrier position as the barrier moves between the deployed and the retracted positions; and a pathway comprising a resilient line and an electrical line between the sensor and the control system, the electrical line being configured to transmit electrical signals between the sensor and the control system, and the resilient line being at least partially housed in a support structure and configured to resiliently extend from the support structure and retract into the support structure as the barrier is moved between the deployed position and the retracted position.

13. The system of claim 12 wherein the sensor is an optical sensor.

14. The system of claim 12 wherein the sensor is a first sensor, and wherein the system further comprises a second sensor coupled to the second end of the barrier and operably coupled to the control system, the second sensor being positioned to sense when the second end of the barrier contacts a surface as the barrier moves toward the deployed position.

15. The system of claim 12 wherein the sensor is a first sensor, and wherein the system further comprises a second sensor operably coupled to the control system, the second sensor being positioned to sense when the second end of the barrier at least approximately reaches the retracted position.

16. The system of claim 12 wherein the control system is operably coupled to a detector having a first state and a second state, the control system being configured to command the drive assembly to enable movement of the barrier toward the deployed position when the detector is in the second state.

17. The system of claim 12 wherein the control system is operably coupled to a detector having a first state and a second state, the control system being configured to command the drive assembly to enable movement of the barrier toward the deployed position when the detector is in the second state and configured to command the drive assembly to enable movement of the barrier toward the retracted position when the barrier is not in the retracted position and the detector is in the first state.

18. The system of claim 12 wherein the control system is configured to monitor at least one of a portion of the barrier system and a portion of an external device associated with the barrier system.

19. The system of claim 12, further comprising a power supply coupled to at least one of the drive assembly and the control system, the power supply including a battery unit and a transformer rectifier.

20. The system of claim 12 wherein the drive assembly resists being back-driven so that when power is removed from the drive assembly, the drive assembly resists movement of the barrier.

21. The system of claim 12 wherein the control system is configured with calibration instructions for determining the deployed position and the retracted position when the barrier system is installed proximate to an opening in a structure.

22. The system of claim 12 wherein the control system is configured with interference instructions for moving the barrier toward the retracted position and then toward the deployed position when the control system senses a surface of an object interfering with the barrier moving to the deployed position.

23. A barrier system, comprising:

a barrier with a leading edge, the barrier being movable between a deployed position and a retracted position;

a control system coupled to the barrier and configured to direct movement of the barrier between the deployed position and the retracted position;

an electrical component positioned at the leading edge;

a line with a first end coupled to the control system and a second end coupled to the electrical component, the line having a pathway configured to carry a communication signal between the control system and the electrical component; and a support structure configured to contain at least a portion of the line, wherein the line is configured to move into the support structure as the barrier moves toward the retracted position and out of the support structure when the barrier moves toward the deployed position, wherein the line comprises a resilient cord biased to move into the support structure such that when the barrier moves toward the deployed position the resilient cord is extended, and when the barrier moves toward the retracted position the resilient cord is retracted and moves into the support structure.

24. The barrier system of claim 23 wherein the line comprises a forcing element biased to move into the support structure such that when the barrier moves toward the deployed position the forcing element is extended, and when the barrier moves toward the retracted position the forcing element is shortened and moves into the support structure.

25. The barrier system of claim 24 wherein the forcing element comprises at least one of a bungee cord and elastic tubing.

26. The barrier system of claim 23 wherein the line comprises a cord and a forcing element, wherein at least one of the cord and the forcing element are biased to move into the support structure such that when the barrier moves toward the deployed position the line is extended, and when the barrier moves toward the retracted position the line is shortened and moves into the support structure.

27. The barrier system of claim 23 wherein the line comprises a coiled cord and a forcing element, wherein the forcing element is positioned within the coiled cord.

28. The barrier system of claim 23 wherein the line comprises a cord and a forcing element, and wherein at least one of the cord and the forcing element contains the pathway.

29. The barrier system of claim 23 wherein the support structure comprises an elongated housing with at least one opening through which the line extends.

30. The barrier system of claim 23 wherein the support structure comprises:

a first opening that leads to the electronic component; and a second opening that leads to the control system, wherein at least a portion of the line is connected to the support structure near the second opening, and wherein the pathway is configured to pass through the second opening to reach the control system.

31. The barrier system of claim 23 wherein the support structure comprises a guide element configured to guide the line into and out of the support structure.

32. The barrier system of claim 31 wherein the support structure comprises an elongated housing, and the guide element is configured to cause an approximately 90 degree bend in the line between a first portion of the line inside of the support structure and a second portion of the line that extends out of the support structure.

33. The barrier system of claim 32 wherein the guide element comprises at least one of a pulley, a low friction surface, a race, a bearing, or a mechanical guide.

34. The barrier system of claim 23 wherein the electronic component comprises a sensor configured to detect a proximity between the leading edge and an object.

* * * * *

UNITED STATES PATENT AND TRADEMARK OFFICE

CERTIFICATE OF CORRECTION

PATENT NO. : 8,016,017 B2
APPLICATION NO. : 11/828974
DATED : September 13, 2011
INVENTOR(S) : James N. Cloninger et al.

It is certified that error appears in the above-identified patent and that said Letters Patent is hereby corrected as shown below:

On the title page, in field (56), in column 2, under "Other Publications", line 5, delete "Julu" and insert -- Jul. --, therefor.

In column 6, line 7, delete "NPFA" and insert -- NFPA --, therefor.

In column 6, line 10, delete "flouropolymer" and insert -- fluoropolymer --, therefor.

In column 6, line 11, delete "polytetraflouroethylene" and insert -- polytetrafluoroethylene --, therefor.

Signed and Sealed this
Twenty-fourth Day of January, 2012

David J. Kappos

David J. Kappos
*Director of the United States Patent and Trademark Office*